US005154604A

United States Patent [19]

Arai

[11] Patent Number: 5,154,604

[45] Date of Patent: Oct. 13, 1992

[54] CURING APPARATUS

[75] Inventor: Mitsuo Arai, Oume, Japan

[73] Assignee: Kabushiki Kaisha Shinkawa, Tokyo, Japan

[21] Appl. No.: 847,422

[22] Filed: Mar. 5, 1992

Related U.S. Application Data

[63] Continuation of Ser. No. 692,441, Apr. 23, 1991, abandoned.

[30] Foreign Application Priority Data

Apr. 23, 1990 [JP] Japan ..... 2-105301

[51] Int. Cl.[5] ..... F27B 9/28

[52] U.S. Cl. ..... 432/59; 432/146; 432/148; 432/175; 432/194

[58] Field of Search ..... 432/146-148, 432/153-155, 175, 189, 194, 196, 59

[56] References Cited

U.S. PATENT DOCUMENTS

| | | | |
|---|---|---|---|
| 1,596,214 | 8/1926 | O'Brien | 432/194 |
| 4,357,762 | 11/1982 | Eustacchio | 432/194 |
| 4,482,314 | 11/1984 | Giese et al. | 432/146 |
| 4,529,379 | 7/1985 | Di Castri | 432/148 |
| 4,569,660 | 2/1986 | Bossett | 432/148 |
| 4,790,749 | 12/1988 | Mauro | 432/175 |
| 4,792,302 | 12/1988 | Baker et al. | 432/59 |
| 4,936,772 | 6/1990 | Zajac | 432/148 |

*Primary Examiner*—Henry C. Yuen
*Attorney, Agent, or Firm*—Koda and Androlia

[57] ABSTRACT

A curing apparatus used in manufacturing semiconductor devices including high-temperature gas chamber and heating chamber communicated with slits formed in a partition plate installed between the two chambers. Gas diffusion plates are installed in the gas chamber at right angles against the flow of gas so that the diffused and uniform high-temperature gas passes through slits and blown onto workpieces placed directly beneath the slits.

3 Claims, 1 Drawing Sheet

CURING APPARATUS

BACKGROUND OF THE INVENTION

1. Field of the Invention

The present invention relates to a curing apparatus for drying a thermo-setting bonding agent such as a silver paste, etc. applied to plate-form parts such as lead frames, etc.

2. Prior Art

In semiconductor device manufacturing processes, workpieces consisting of dies bonded to lead frames via a thermo-setting bonding agent are heated by a curing apparatus so that the thermo-setting bonding agent is dried to fix the dies to lead frames. Generally, to heat (and drying) the workpieces, heating blocks are used.

If the temperature in the vicinity of the surfaces of the workpieces drops, impurity gases (which are generated by the pyrolysis of the thermo-setting bonding agent) cool down and solidify to form particles. These particles tend to remain on the surfaces of the workpieces, thus decreasing the quality of the finished product. One way to prevent these drawbacks is to blow a high-temperature inert gas to the vicinity of the workpiece surfaces from above, thus preventing the conversion of the impurity gases into particles and cleaning the workpiece. The impurity gases are then discharged and removed.

There are three high-temperature inert gas supply systems in prior art: one-way systems, high-temperature gas chamber systems and pipe systems. In the one-way systems, a high-temperature gas is caused to flow along the surfaces of workpieces from one end, and the gas is discharged from the other end. In the high-temperature gas chamber systems, a high-temperature gas is supplied into a high-temperature gas chamber installed above a workpiece heating area and is then supplied to the surface of workpieces through slits which are formed in the bottom of the high-temperature gas chamber. In the pipe systems, a high-temperature gas is blown into a pipe installed above the workpiece heating area. The gas is supplied to the surfaces of workpieces via holes which are opened in the bottom of the pipes.

The curing devices of the types described above may be found in, for example, Japanese Patent Application Laid-Open ("Kokai") Nos. 63-239957 and 63-316443 and Japanese Utility Model Application Laid-Open ("Kokai") No. 2-8033.

Of the above prior art systems, in the one-way systems, the cleaning efficiency of the workpiece varies depending upon the positional relationship between the workpiece and the flow of the high-temperature gas. More specifically, workpieces near the high-temperature gas inlet are constantly covered by a fresh supply of the high-temperature gas and therefore cleaned well. However, the gas which has flown along the surfaces of the preceding workpieces is supplied onto the workpieces placed near the high-temperature gas outlet. Accordingly, impurities and gases which have been contaminated by the preceding workpieces are blown thereto. As a result, cleaning is not performed well. Since there is a temperature differences at the gas inlet area and the gas discharge area, heat curing obtaining equal quality workpieces cannot be expected.

In the high-temperature gas chamber systems, since a high-temperature gas is blown directly onto the surfaces of the workpieces, gas at a uniform temperature cannot be evenly supplied to each of the workpieces.

Thus, it is impossible to obtain workpieces of equal quality.

In the pipe systems, it is difficult to maintain the temperature of the gas inside the pipe constantly. Accordingly, as in the case of the high-temperature gas chamber systems, workpieces of equal quality cannot be obtained. Since the gas is supplied through positionally-fixed holes, the conditions of gas supply change if the lead frames are different in dimensions or spacing between placed on the lead frames is different. Accordingly, stable heating cannot be expected for different types of products.

OBJECT OF THE DISCLOSURE

Accordingly, the object of the present invention is to provide a curing apparatus wherein a uniform degree of cleaning on each workpiece is accomplished and uniform heating of the workpieces is executed, thus securing high quality workpieces.

The object of the present invention is achieved by a unique structure of a curing apparatus that uses diffusion plates. More spcifically, the curing apparatus comprises heating blocks on which workpieces consisting of dies bonded to plate-form parts via a thermo-setting bonding agent are placed and heated, a high-temperature gas chamber installed above the heating blocks and provided with gas supply ports formed in its bottom wall, a high-temperature gas supply means which supplies a high-temperature gas to the high-temperature gas chamber, and diffusion plates installed inside the high-temperature gas chamber so as to diffuse the high-temperature gas supplied into the high-temperature gas chamber.

By taking the structure described above, the high-temperature gas supplied into the high-temperature gas chamber via the high-temperature gas supply means is diffused by the diffusion plates so that the gas, as a result, has an evenly high temperature as a whole. Since the high-temperature gas with a uniform temperature is supplied to each of the workpieces through the gas supply ports, an even-quality curing can be accomplished. In addition, since the high-temperature gas is evenly blown onto each one of the workpieces, all the workpieces are covered by fresh high-temperature gas, and the workpieces are uniformly cleaned.

DETAILED DESCRIPTION OF THE INVENTION

Figure 1:
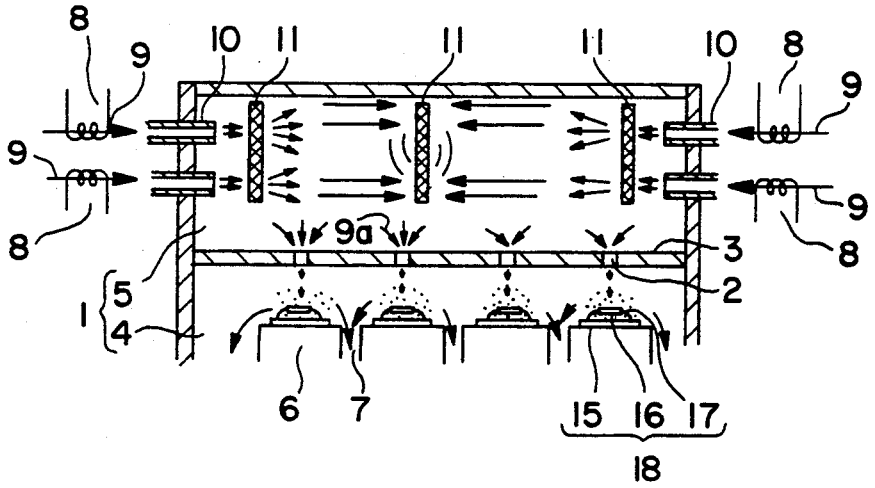
FIG. 1 is a cross section of one embodiment of the present invention.
Figure 2:
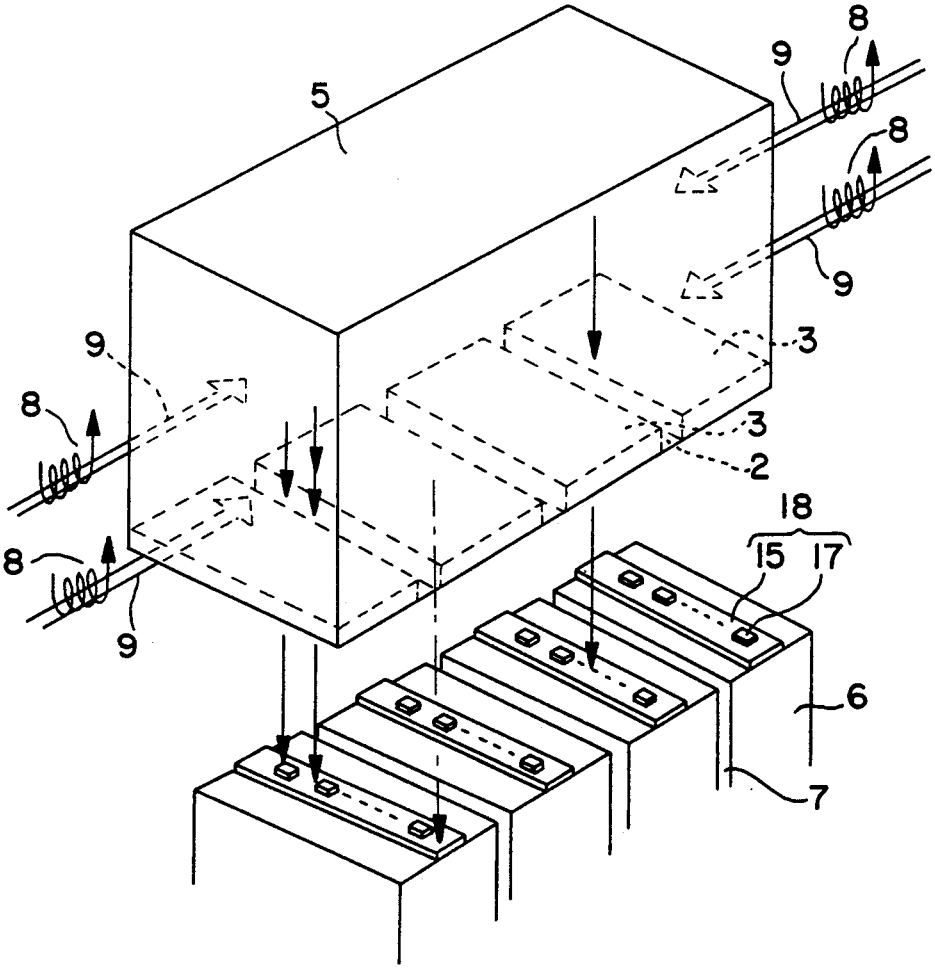
FIG. 2 is a schematic oblique view of the structure shown in FIG. 1.

One embodiment of the present invention will be described with reference to the accompanying drawings:

The curing chamber 1 is divided into a workpiece heating chamber 4 and a high-temperature gas chamber 5 by a partition plate 3 which has slits 2 of a fixed width. The partition plate 3 can be a bottom wall of the gas chamber with slits formed therein. The slits 2 are formed parallel to each other.

Inside the workpiece heating chamber 4, a multiple number of heating blocks 6 are installed. The heating blocks 6 are parallel to each other with a fixed space 7 between adjacent heating blocks 6 so that each of the slits 2 corresponds to each of the surfaces of the heating blocks 6.

On the two end-walls of gas chamber 5, a plurality of pipes 10 are provided to supply a high-temperature inert gas 9 heated by heaters 8 into the high-temperature gas chamber 5.

Furthermore, a plurality of diffusion plates 11 are installed inside the high-temperature gas chamber 5 so that when the high-temperature gas 9 supplied via the pipes 10 into the gas chamber 5, the gas strikes against the diffusion plates 11 and is diffused thereby as shown by arrows in FIG. 1 and its temperature becomes uniform. The diffusion plates are made of very fine mesh or plates with numerous minute holes formed therein, and each diffusion plate comprises three to five fine mesh and/or holed-plates put together side by side.

In operation, workpieces 18, each consisting of a die 17 which is bonded to lead frames 15 via a thermo-setting bonding agent 16 consisting of Ag, etc., are successively conveyed across the top surfaces of the heating blocks 6 by tact-transfer and cured. During this process, high-temperature gas 9*a* inside the high-temperature gas chamber 5 is blown onto the workpieces 18 through the slits 2 and is discharged downward between the spaces 7. As a result, impurity gases in the vicinity of the surfaces of the workpieces 18 are discharged along with the thus discharged high-temperature gas 9*a*.

In the above operation, when the high-temperature gas 9 is supplied into the high-temperature gas chamber 5 via the pipes 10, it strikes against the diffusion plates 11 and is mixed so that a turbulent flow is created. The high-temperature gas 9 is thus diffused without generating a skewed temperature distribution inside the high-temperature gas chamber 5. As a result, a gas of uniform temperature is obtained. The high-temperature gas 9*a* which has been diffused and thus has a uniform temperature is blown out of the gas chamber 5 and supplied onto the workpieces 18 through the slits 2, resulting in uniform-quality curing can be accomplished. Since the uniform temperature gas 9*a* is blown onto each workpiece 18, all the workpieces 18 are constantly and evenly covered with fresh high-temperature gas 9*a*, so that all the workpieces 18 are uniformly cleaned.

In this embodiment, one slit is provided for each workpiece 18. As a result, the high-temperature gas 9*a* is blown, in a linear form, onto each workpiece 18 directly from the above through the corresponding slit 2 without taking any wasteful path. However, this does not mean to exclude providing of a plurality of through-holes in stead of the slits.

In addition, since the slits 2 can be formed by arranging a plurality of partition plates side by side with spaces in between, the manufacturing costs of the apparatus is reduced.

According to the present invention, as is clear form the above description, a high-temperature gas with a uniform temperature is supplied to each workpiece. As a result, uniform-quality curing can be accomplished. Since the high-temperature gas is blown onto each workpiece, all the workpieces are constantly covered with fresh high-temperature gas. Thus, the workpieces are uniformly cleaned.

I claim:

1. A semiconductor device manufacturing apparatus for drying thermal setting bonding agents, said apparatus comprising: heating blocks on which workpieces consisting of dies bonded to plate-form parts via a thermo-setting bonding agent are placed and heated; a high-temperature gas chamber installed above said heating blocks, said gas chamber having gas supply ports formed in the bottom wall; a heating chamber provided subjacent to and communicating with said high-temperature gas chamber via said gas supply parts; a high-temperature inert gas supply means provided on said gas chamber for supplying a flow of high-temperature inert gas to said high-temperature gas chamber; and a plurality of diffusion plates installed inside said high-temperature gas chamber transverse to said flow of said high-temperature inert gas to diffuse said high-temperature inert gas supplied by said high-temperature gas supply means, each of said diffusion plates comprising a plurality of mesh plates put together side by side.

2. A curing apparatus according to claim 1, wherein said gas supply ports are slits, each of which is installed so as to face each of said heating blocks.

3. A curing apparatus for drying thermal setting bonding agents used in manufacturing semiconductor devices comprising:

a high-temperature gas chamber;

a heating chamber communicated with said high-temperature gas chamber via slits provided in a partition plate;

heating blocks provided in said heating chamber, each of said heating blocks being directly beneath each of said slits and upon said heating blocks workpieces each consisting of dies bonded to plate-form parts via a thermo-setting bonding agent are placed;

gas supply pipes opened in said gas chamber for supplying high-temperature inert gas into said gas chamber;

heating elements provided on said gas supply pipes; and diffusion plates provided in said gas chamber so that said high-temperature inert gas supplied into said gas chamber strikes against said diffusion plates and thereby become uniform in temperature and then is blown onto said workpieces through said slits.

* * * * *